United States Patent [19]

Golbeck et al.

[11] 4,348,569

[45] Sep. 7, 1982

[54] ROTARY SWITCH

[75] Inventors: Bernard J. Golbeck, Crystal Lake; Raymond F. Lewandowski, Mount Prospect, both of Ill.; Donald A. Rentzsch, Burlington, Wis.; Lonnie J. Richardson, Elgin, Ill.

[73] Assignee: Oak Industries Inc., Rancho Bernardo, Calif.

[21] Appl. No.: 178,455

[22] Filed: Aug. 15, 1980

[51] Int. Cl.[3] ..... H01H 19/14

[52] U.S. Cl. ..... 200/155 R

[58] Field of Search ..... 200/155 R, 293, 241, 200/336, 11 R

[56] References Cited

U.S. PATENT DOCUMENTS

| | | | |
|---|---|---|---|
| 2,064,157 | 12/1936 | Franklin | 200/155 R |
| 3,780,245 | 12/1973 | Beddow | 200/155 R |
| 4,034,178 | 7/1977 | Koppenheffer et al. | 200/293 |
| 4,154,991 | 5/1979 | Hickman et al. | 200/336 |

FOREIGN PATENT DOCUMENTS

| | | | |
|---|---|---|---|
| 1170499 | 5/1964 | Fed. Rep. of Germany | 200/155 R |

*Primary Examiner*—Willis Little

*Attorney, Agent, or Firm*—Kinzer, Plyer, Dorn & McEachran

[57] ABSTRACT

A rotary switch construction wherein a stator has a pocket for receiving a rotor. The rotor has a flexible rim which permits it to snap-fit into the pocket of the stator. A plurality of angled surfaces on the stator compress the rotor rim as it is inserted into the pocket of the stator. Retainer means are provided to hold the rotor in the stator. The rotor further includes a plurality of stop pairs. The stator has a single, fixed stop which is disposed between the stops of one of the pairs on the rotor. The rotor stops have variable arcuate spacing so that, depending on which pair of stops spans the fixed stop, the degree of rotational freedom of the rotor can be selected. In another aspect, the rotary switch includes means on the rotor for fastening the rotor blade in place.

14 Claims, 11 Drawing Figures

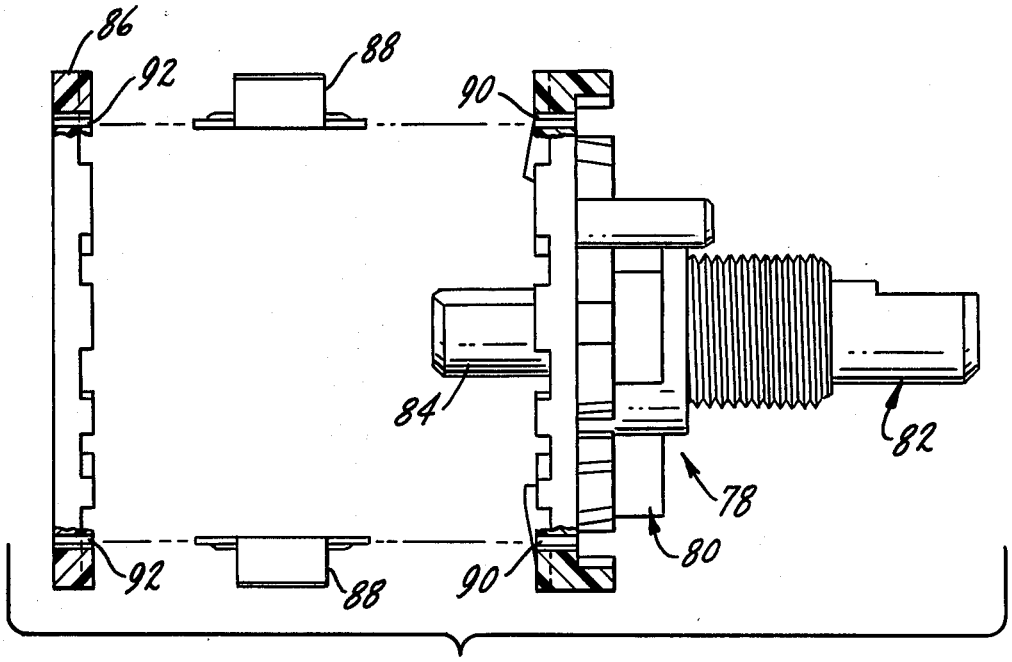
Fig. 6.
Fig. 7.
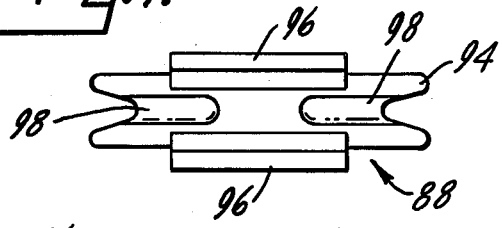
Fig. 8.
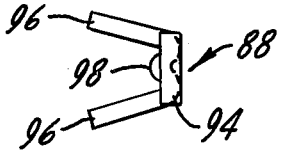
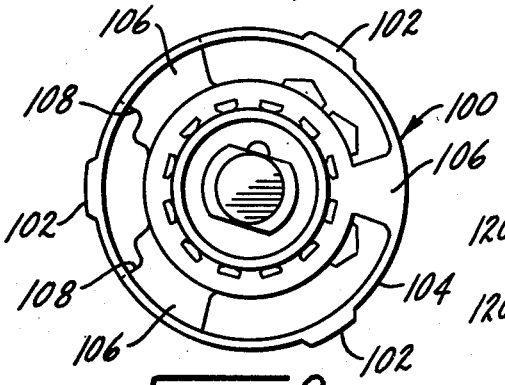
Fig. 9.
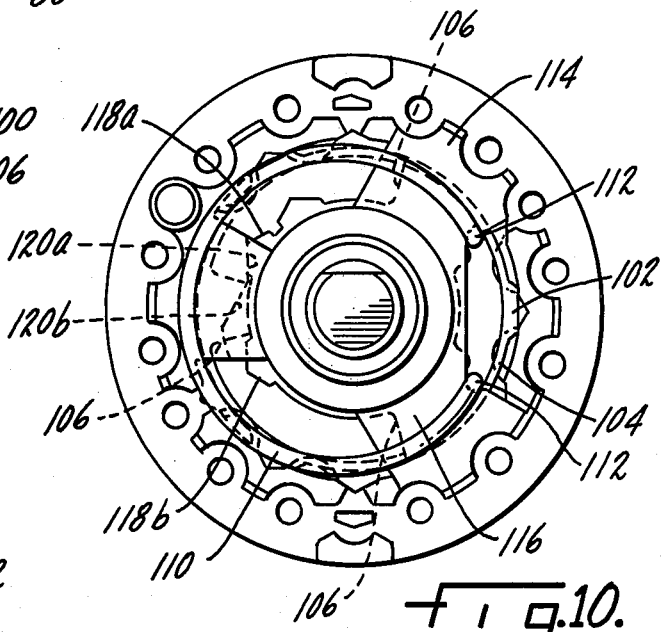
Fig. 10.
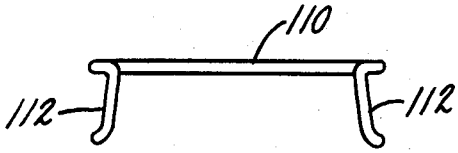
Fig. 11.

ROTARY SWITCH

SUMMARY OF THE INVENTION

This invention relates to rotary switches.

A primary object of the present invention is a rotary switch which is inexpensive to manufacture yet reliable in operation.

Another object is a rotary switch which can be adapted to be used either as a momentary type switch or as a multi-position index type switch.

Another object is a rotary switch in which the number of index positions can be varied, depending on the initial orientation of the rotor.

Another object of the present invention is a rotary switch wherein the rotor can be inserted into the stator with a snapfit arrangement which will retain the rotor.

Another object is a rotary switch wherein the rotor has means for retaining the rotor blade in position.

Another object is a rotary switch which can be adapted to carry additional stator sections.

Another object is a rotary switch wherein the rotor and stator are formed of suitable plastic material.

Other objects will appear in the ensuing specification, drawings and claims.

BRIEF DESCRIPTION OF THE DRAWINGS

FIG. 6 is an exploded view of a rotary switch having an additional stator section.

FIG. 7 is a top plan view of a strut spacer for use between sections of a multi-stator rotary switch of FIG. 6.

FIG. 8 is an end view of the strut spacer.

FIG. 9 is a front plan view of a rotor for use with a spring return in a momentary type switch.

FIG. 10 is a front plan view of a momentary type rotary switch.

FIG. 11 is a side view of the spring used in the momentary type switch of FIG. 10.

DESCRIPTION OF A PREFERRED EMBODIMENT

Figure 1:
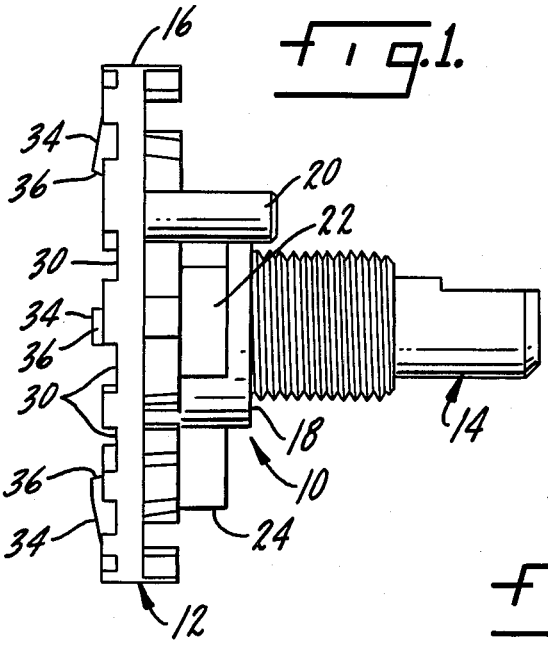
FIG. 1 is a side elevation view of a rotary switch according to the present invention.

This invention is directed to an economical rotary switch. The switch is shown generally at 10 in FIG. 1. The switch comprises a stator 12 and a rotor 14, only the shaft of which can be seen in FIG. 1. The stator 12 includes a circular body portion 16 and a central bushing 18, an end portion of which may be threaded as shown. The bushing is used for mounting the switch. Alternately, the bushing could have a smooth surface for use with a push-on fastener. In this connection a post 20 extending from the body portion 16 of the stator may be used to assist in orienting the switch when it is mounted.

Figure 3:
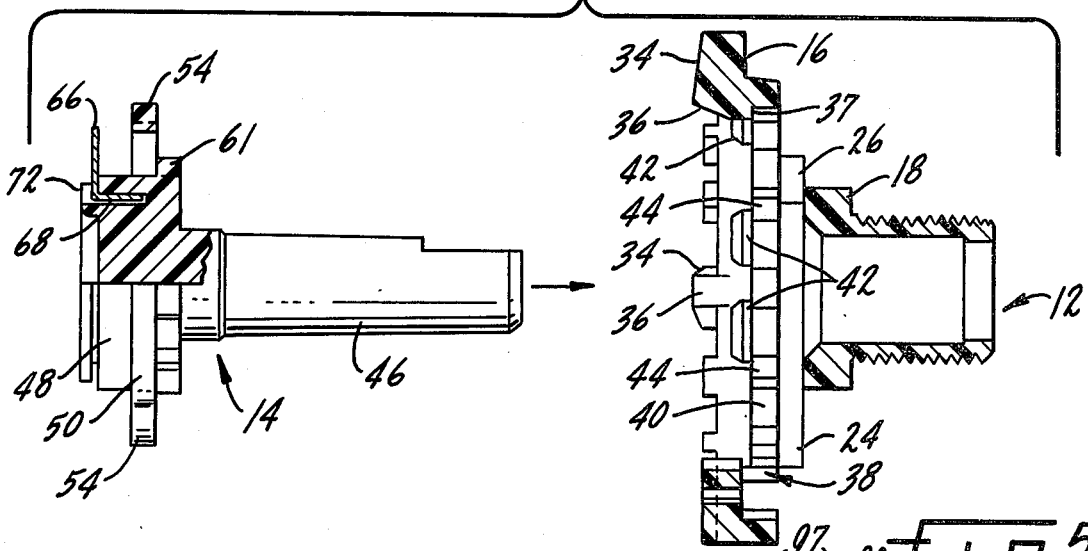
FIG. 3 is an exploded section, taken along line 3—3 of FIG. 2.
Figure 5:
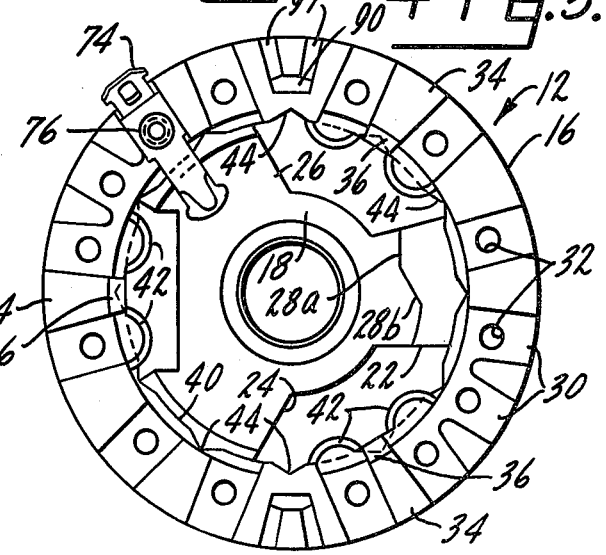
FIG. 5 is a bottom plan view of a stator.

The body portion 16 and the bushing 18 are connected by three web members 22, 24 and 26 as shown in FIG. 5. The underside of the web 22 includes a fixed stop which has stop faces 28*a* and 28*b*. The purpose of the stop will be explained below. The underside of the main body portion 16 has a plurality of radial slots 30 including holes 32 for receiving and fastening the short contact clips (not shown). The body portion 16 also has three upraised surfaces 34 which extend outwardly from the main plane of the body portion 16. At the inside edge of the upraised surfaces 34 is a slanted surface 36 which terminates at a lip 37 (FIG. 3). The slanted surfaces 36 assist in the insertion of the rotor 14 as will be more fully explained below.

Looking at FIG. 3, it can be seen that the interior of the body portion 16 of the stator 12 forms a pocket 38 for receiving the rotor. The pocket is defined by the underside of the webs 22, 24 and 26 together with an annular surface 40 and retainer means 42. The annular surface 40 includes a plurality of detents 44 which define specific switch positions. The detents 44 are equally spaced around the annular surface.

Figure 2:
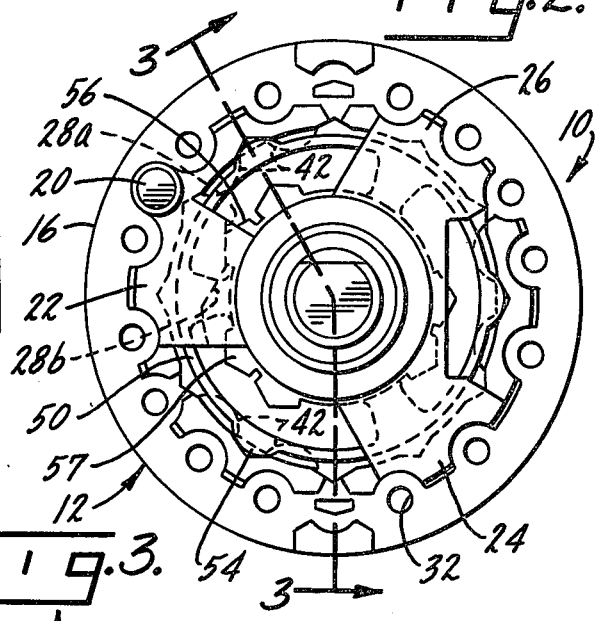
FIG. 2 is a front, plan view of the rotary switch.
Figure 4:
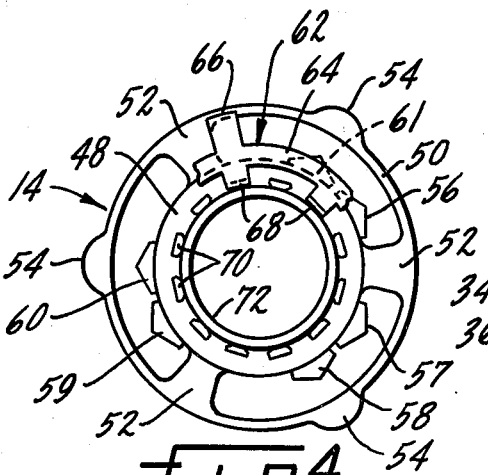
FIG. 4 is a bottom plan view of a rotor.

The rotor 14 is best seen in FIGS. 3 and 4. The rotor includes a shaft 46 protruding from a central hub portion 48. A flexible rim 50 encircles the hub 48. The rim 50 is attached to the hub by three spokes 52. Three index bumps 54 are formed on the perimeter of the rim 50. When assembled the index bumps 54 cooperate with the detents 44 to define the various switch positions (FIG. 2). The rotor includes a plurality of stops 56, 57, 58, 59, 60 and 61 which are attached to the hub 48. As best seen in FIG. 4, the stops are arcuately spaced. The spacing of the stops is arranged so that varying degrees of rotation can be obtained, as will be more fully explained below.

FIGS. 4 and 5 show the switch contacts or clips. The rotor carries a rotor blade 62. This blade has a main circular portion 64 and a wiper portion 66. A plurality of legs 68 extend from the circular portion 64 and into holes 70 in the hub of the rotor. The rotor includes a sleeve 72 for fastening the rotor blade 62 to the rotor. Prior to fastening of the rotor blade, the sleeve 72 is a cylindrical member, generally co-axial with the axis of the shaft 46. The main circular portion 64 of the blade defines a central opening which permits the blade to fit over the cylindrical sleeve. The legs 68 are inserted into holes 70 and then the sleeve 72 is swaged over a portion of the blade to hold it in place. This is best shown in FIG. 3. The swaging can be accomplished by either an ultrasonic deformation operation or a heating operation. The sleeve provides an inexpensive means for fastening the rotor blade.

FIG. 5 shows a long or common clip 74 which is fastened to the body portion 16 of the stator by a rivet 76. The long clip extends inwardly where it contacts the circular portion 64 of the rotor blade 62. The wiper 66 of the rotor blade contacts one of the short clips (not shown) which are held in the slots 30.

The rotor 14 and the stator 12 are assembled in a manner indicated by the arrow in FIG. 3. In preparation for insertion of the rotor into the stator, the index bumps 54 are aligned with the slanted surfaces 36. As the rotor is pressed into the stator, the slanted surfaces 36 compress the flexible rim 50. This permits the rim to clear the retaining means 42. When the rim is fully inserted past the lip 37 it will snap back to nearly its original position. As best seen in FIG. 2, the retaining means 42 then overlaps the rim 50 to hold the rotor in place. The rotor shaft 46 extends through the opening in the bushing 18 and the rim 50 of the rotor is held in the stator pocket 38.

The index bumps 54 engage the detents 44 when the rotor is fully inserted to define the indexed positions of the switch. When it is desired to change positions, the flexibility of the rotor rim 50 allows the bump to flex out of engagement with one detent and then snap into engagement with the next detent. The detents, and therefore the index positions of the switch, are arcuately spaced by a unit angle. In the embodiment shown the unit angle is 30° making it possible to have as many as twelve index positions.

The number of available index positions in a particular switch can be varied between two and twelve. The fixed stop 28 and the rotor stops 56–61 combine to limit the rotation of the rotor to the desired number of positions. The rotor stops are spaced such that every multiple of the unit angle (between two and twelve) is defined by the angle between some pair of stops. When the rotor is initially inserted, the pair of stops having the desired unit angle multiple, and therefore the desired number of index positions, is arranged to span the fixed stop. In other words, the fixed stop is located between the stops having the desired unit angle multiple. For example in FIG. 2, the fixed stop 28 is disposed between a pair of rotor stops, in this case the stop pair 56 and 57. The arcuate spacing of this stop pair is 60° so the unit angle multiple is two. Thus, the stop pair 56, 57 permits the rotor to rotate between two indexed positions. In one of these positions the stop 56 engages the stop face 28*a*, as shown in FIG. 2. In the other position the stop 57 engages the stop face 28*b*. Thus when the stop pair 56, 57 spans the fixed stop 28 the rotary switch is a two-position switch.

The various combinations of rotor stop pairs provide the other unit angle multiples. Pair 58, 59 is spaced 90°, a unit angle multiple of three, so this pair provides a three-position switch. Pair 60, 61 is spaced 120° and provides a four-position switch. The unit angle multiples five through twelve require that one or more of the stops be removed. The plastic material allows the stops to be sheared off. The following table shows the stops that must be removed to obtain a given number of switch positions.

| # of switch positions | remove stops | stop pair spanning fixed stop (reading clockwise in FIG. 4 from 1st stop to 2nd stop) |
|---|---|---|
| 5 | 61 | 60,56 |
| 6 | 60,61 | 59,56 |
| 7 | 56,61 | 60,57 |
| 8 | 59,60 | 58,61 |
| 9 | 59,60,61 | 58,56 |
| 10 | 58,59,60,61 | 57,56 |
| 11 | 56,57,58,61 | 60,59 |
| 12 | 56,57,58,59,61 | 60 |

It will be noted that the twelve-position switch leaves only one stop on the rotor. As used herein this will be considered a "pair" of stops since opposite side of the stop will contact the fixed stop 28. Only one stop pair is operative in a given switch. The orientation of the rotor when it is inserted determines which pair will span the fixed stop and thus be the operative pair. Thus the same rotor can be used to provide a variable-position switch. Of course, the number and spacing of the pairs could be other than that shown. In an alternate configuration, the rotor stops could be insertable in the rotor hub 48 at different locations to vary the amount of rotational freedom.

An alternate embodiment of the rotary switch is shown in FIG. 6. In this embodiment the switch 78 has a stator 80 and a rotor 82. These parts may be essentially the same as those previously described with the exception of an additional stub shaft 84 on the rotor. The stub shaft carries an additional rotor blade (not shown) for a second stator section 86. The second section 86 is attached to the first stator section 80 by a pair of strut spacers 88. The strut spacers fit in holes 90 in the first stator section and in holes 92 in the second section. FIGS. 7 and 8 show the details of the strut spacers. Each spacer has an elongated member 94 with a pair of wings 96 extending therefrom. The wings fit into slots 97 (FIG. 5) to prevent relative rotation between the stator sections. An upraised portion 98 extends from the elongated member 94 at either end. This upraised portion assists in holding the strut in the holes in the first and second stator sections.

A further alternate embodiment is shown in FIGS. 9–11. This switch has a spring return so the switch is a momentary type rather than the fixed position type shown above. A modified rotor is shown in FIG. 9 at 100. It will be noted the protrusions 102 on the rim 104 have a flattened surface. Thus the protrusions 102 do not engage the detents as do the index bumps 54. Also, two of the spokes 106 have spring-receiving notches 108. The spring itself is shown in FIG. 11. It has a generally circular portion 110 with legs 112 depending therefrom. There is a gap between the legs which can be partially closed when the spring is compressed.

Looking at FIG. 10, the spring fits generally on top of the web members, with the spring legs engaging the webs 114 and 116 of the stator. The legs 112 also extend downwardly so that they lie in notches 108 of the rotor. When the rotor is turned one leg of the spring is moved by the rotor toward the other which is held fixed by the stator web. The extent of the rotation is limited by stops 118 abutting a fixed stop 120. When the rotor is released the spring returns to the position shown in FIG. 10.

It will be realized that whereas a practical and operative device has been shown and described, nevertheless, many changes may be made in size, shape and disposition of parts without departing from the spirit and scope of the invention. It is therefor desired that the description and drawings be taken in a broad sense as illustrative and diagrammatic rather than as limiting the invention to the specific showings.

We claim:

1. A rotary switch comprising a rotor having a flexible rim, a stator having a pocket for receiving the rotor, and retainer means formed on the stator for holding the rotor in the stator, the rim flexing past the retainer means upon initial assembly of the switch to permit entry of the rotor into the pocket, the rim thereafter snapping back to engage the retainer and hold the rotor in the pocket.

2. The structure of claim 1 further including at least one angled surface formed on the stator and arranged to compress the flexible rim as the rotor is inserted into the stator pocket.

3. The structure of claim 1 wherein the flexible rim comprises a ring of flexible material attached to the rotor by at least two spokes.

4. The structure of claim 1 wherein the pocket includes an annular surface having a plurality of detents, and the rim has at least one index bump normally engaging a detent to hold the rotor in a specific position, the rim flexing upon rotation of the rotor to allow the index bump to move from one detent to the next.

5. The structure of claim 1 further comprising a spring which biases the rotor to a normal rest position, making the switch a momentary type switch.

6. The structure of claim 1 further characterized in that the switch has a plurality of index positions spaced apart by a unit angle, the rotor having a plurality of stops formed thereon, the rotor stops being spaced such that the angles between the various combinations of stop pairs comprise a plurality of multiples of the unit angle, the stator having a fixed stop located between a selected pair of rotor stops and in the path thereof so as to limit the rotor's rotation to the unit angle multiple of the selected stop pair.

7. The structure of claim 6 wherein one or more of the stops are removed to obtain a pair having a desired unit angle multiple.

8. The structure of claim 6 wherein the unit angle is 30° and the stops provide multiples from two through twelve.

9. A rotary switch comprising a rotor, a stator and a rotor blade said rotor having opening means into which a portion of said rotor blade extends, the rotor also including a sleeve for fastening the blade to the rotor, the sleeve being swaged over a further portion of the blade after placement of the blade in the rotor.

10. The structure of claim 9 wherein the rotor is made of plastic material and the sleeve is swaged by an ultrasonic deformation operation.

11. The structure of claim 9 wherein the rotor blade has a central opening through which the sleeve extends prior to the swaging operation.

12. A rotary switch of the type having a stator and a rotatable rotor which can assume any of a plurality of index positions, the index positions being spaced apart by a unit angle, the rotor having a plurality of stops formed thereon, the rotor stops being spaced such that the angles between the various combinations of stop pairs comprise a plurality of multiples of the unit angle, the stator having a fixed stop located between a selected pair of rotor stops and in the path thereof so as to limit the rotor's rotation to the unit angle multiple of the selected stop pair.

13. The structure of claim 12 wherein one or more of the stops are removed to obtain a pair having a desired unit angle multiple.

14. The structure of claim 12 wherein the unit angle is 30° and the stops provide multiples from two through twelve.

* * * * *